US007771090B2

(12) United States Patent
Chang et al.

(10) Patent No.: US 7,771,090 B2
(45) Date of Patent: Aug. 10, 2010

(54) HEAT-DISSIPATION STRUCTURE

(75) Inventors: Kun-Jung Chang, Kaohsiung County (TW); Ching-Yuan Juan, Kaohsiung County (TW); Kuo-Chun Lin, Kaoshiung County (TW); Ching-Huang Juan, Kaohsiung County (TW)

(73) Assignee: Li-Hong Technological Co., Ltd. (TW)

( * ) Notice: Subject to any disclaimer, the term of this patent is extended or adjusted under 35 U.S.C. 154(b) by 406 days.

(21) Appl. No.: 12/042,634

(22) Filed: Mar. 5, 2008

(65) Prior Publication Data

US 2009/0225554 A1 Sep. 10, 2009

(51) Int. Cl.
*F21V 29/00* (2006.01)

(52) U.S. Cl. ..... 362/294; 362/311; 362/373

(58) Field of Classification Search ..... 362/294, 362/311, 373, 147

See application file for complete search history.

(56) References Cited

U.S. PATENT DOCUMENTS

| | | | | |
|---|---|---|---|---|
| 7,175,329 | B1 * | 2/2007 | Chou | 362/612 |
| 2007/0081338 | A1 * | 4/2007 | Kuan | 362/294 |
| 2008/0089071 | A1 * | 4/2008 | Wang | 362/294 |
| 2009/0154167 | A1 * | 6/2009 | Lin | 362/294 |

* cited by examiner

*Primary Examiner*—Ali Alavi
(74) *Attorney, Agent, or Firm*—Frenkel & Associates

(57) ABSTRACT

An improved heat-dissipation structure includes a heat-dissipation lamp frame which comprises: a heat-dissipation structure and a plurality of heat-dissipation lamp sets. The heat-dissipation structure has a plurality of heat-dissipation fins on one side thereof, and the heat-dissipation lamp sets are accommodated on the other side of the heat-dissipation structure. An inlay slot is formed along the perimeter of the heat-dissipation lamp sets and is used to accommodate a light guiding tube which is a hollow and tube-like structure and has an inlay rim. The light guiding tube passes through the opening and is inlaid in the inlay slot of the heat-dissipation lamp frame. A casing is a metallic shell and has a through-hole on one side thereof to accept the heat-dissipation lamp frame. The casing has an opening on the other side thereof. A light-permeable cover is a light-permeable hood and has a contact plane on one side thereof.

5 Claims, 15 Drawing Sheets

HEAT-DISSIPATION STRUCTURE

FIELD OF THE INVENTION

The present invention relates to an improved heat-dissipation structure, particularly to a heat-dissipation structure for a high-brightness LED streetlight.

BACKGROUND OF THE INVENTION

The conventional streetlight usually adopts high-brightness and high-power light emitting elements to achieve high brightness, and the heat is dissipated by the casing of the streetlight. However, the conventional technology has the following disadvantages:

1. As the conventional streetlight adopts high-brightness and high-power light emitting elements, it has a very amazing power consumption. In such an age that energy is being exhausted, the conventional streetlight is not the best choice.

2. Because of high power consumption, the conventional streetlight generates so much heat that the casing thereof is hard to dissipate heat effectively, which may overheat the casing and burn out the light emitting element.

SUMMARY OF THE INVENTION

The primary objective of the present invention is to provide an improved heat-dissipation structure, which is superior to the conventional heat-dissipation structure of streetlights and can achieve high brightness, low power consumption and high heat-dissipation efficiency.

To achieve the abovementioned objective, the present invention proposes an improved heat-dissipation structure, which comprises: a heat-dissipation lamp frame, a casing, a light guiding tube and a light-permeable cover. The heat-dissipation lamp frame further comprises: a heat-dissipation structure and a plurality of heat-dissipation lamp sets. The heat-dissipation structure has a plurality of heat-dissipation fins on one side thereof, and the heat-dissipation lamp sets are accommodated on the other side of the heat-dissipation structure. An inlay slot, which is to be engaged with the light guiding tube, is formed along the perimeter of the heat-dissipation lamp sets and on the heat-dissipation structure. The heat-dissipation lamp set further comprises: a plurality of heat-conduction pipes and a plurality of LED (Light Emitting Diode) lamp sets. The heat-conduction pipe is a hollow metallic pipe capable of heat conduction. One end of the heat-conduction pipe has a plane, and the LED lamp set is installed in the plane. The casing is a metallic shell and has a through-hole on one side thereof to accept the heat-dissipation lamp frame. The casing has an opening on the other side thereof. The light guiding tube passes through the opening and is inlaid in the inlay slot of the heat-dissipation lamp frame. The light guiding tube is a hollow and tube-like structure. The light guiding tube has an inlay rim on one side thereof, which is to be engaged with the inlay slot of the heat-dissipation structure. The light guiding tube has a flange surrounding the other side thereof, which contacts the light-permeable cover tightly. The light-permeable cover is a light-permeable hood and has a contact plane on one side thereof, which will tightly contact the flange of the light guiding tube to implement the joints of the light guiding tube and the light-permeable cover. Because the through-hole of the casing is used to accommodate the heat-dissipation lamp frame, the inner dimensions of the through-hole are slightly smaller than the outer dimensions of the heat-dissipation lamp frame. Besides, the dimensions of the opening of the casing are slightly larger than the outer dimensions of the light guiding tube.

DETAILED DESCRIPTION OF THE PREFERRED EMBODIMENTS

Figure 1:
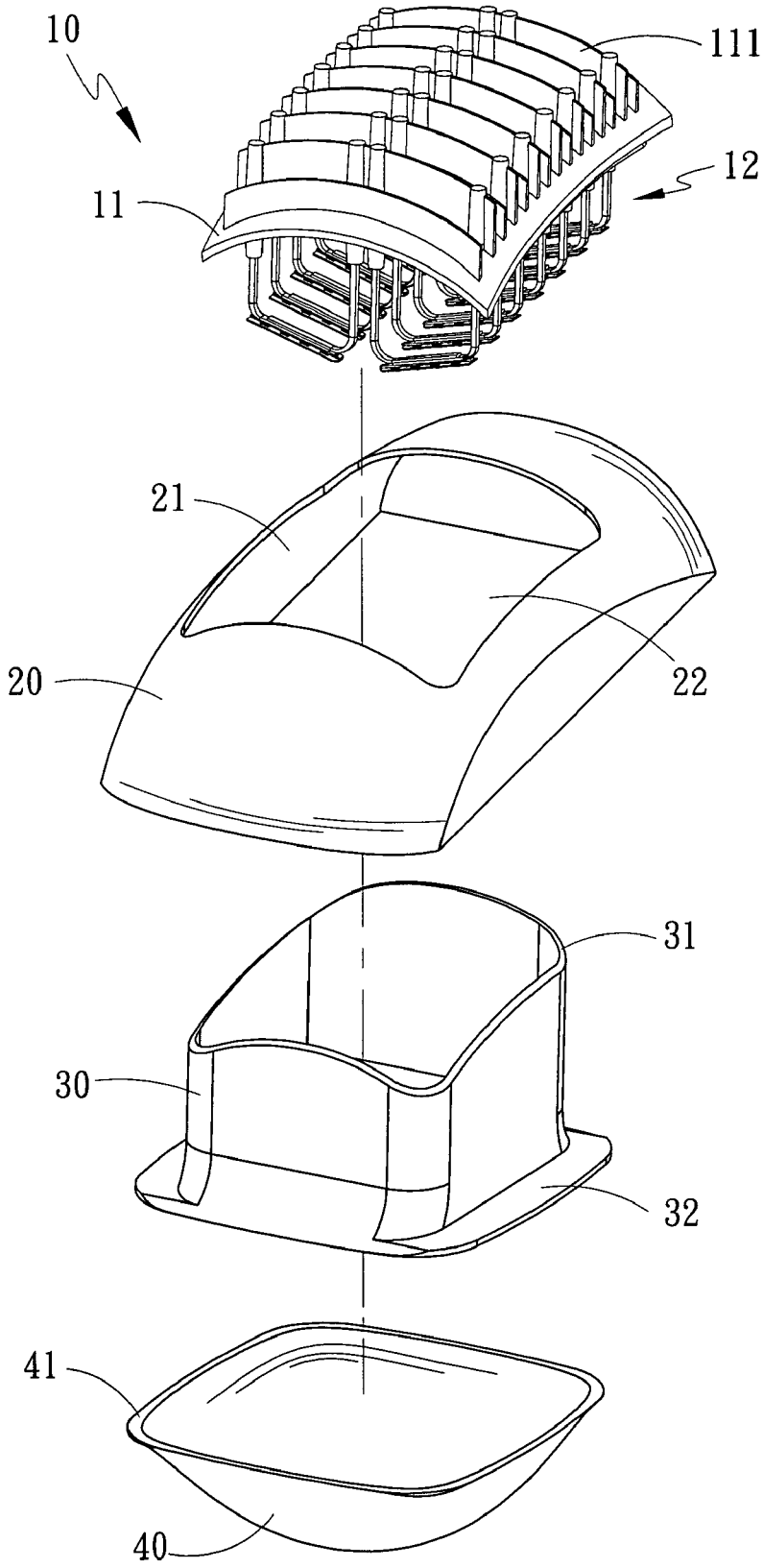
FIG. 1 is a perspective exploded view of an improved heat-dissipation structure according to the present invention.
Figure 2:
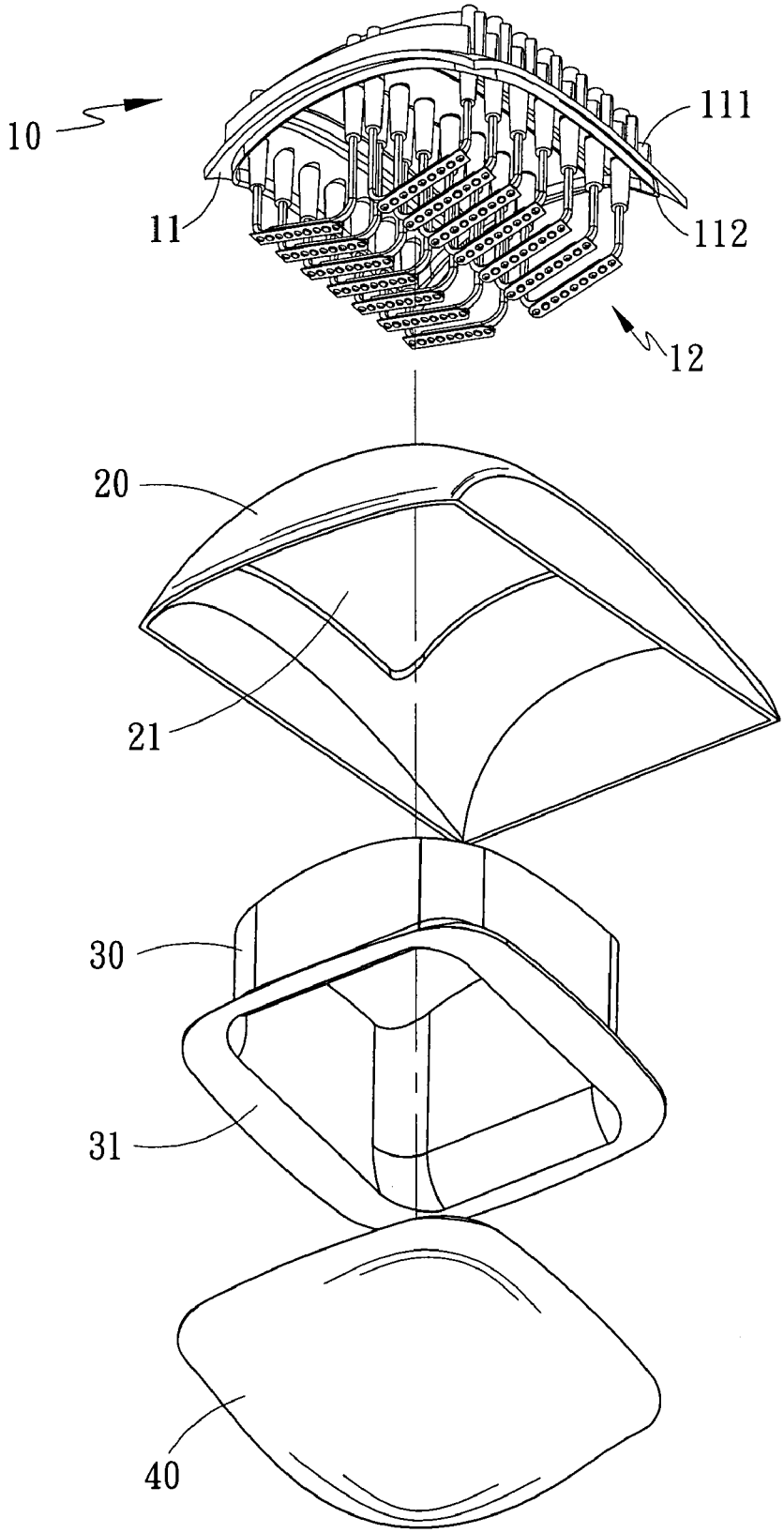
FIG. 2 is another perspective exploded view of an improved heat-dissipation structure according to the present invention.
Figure 3:
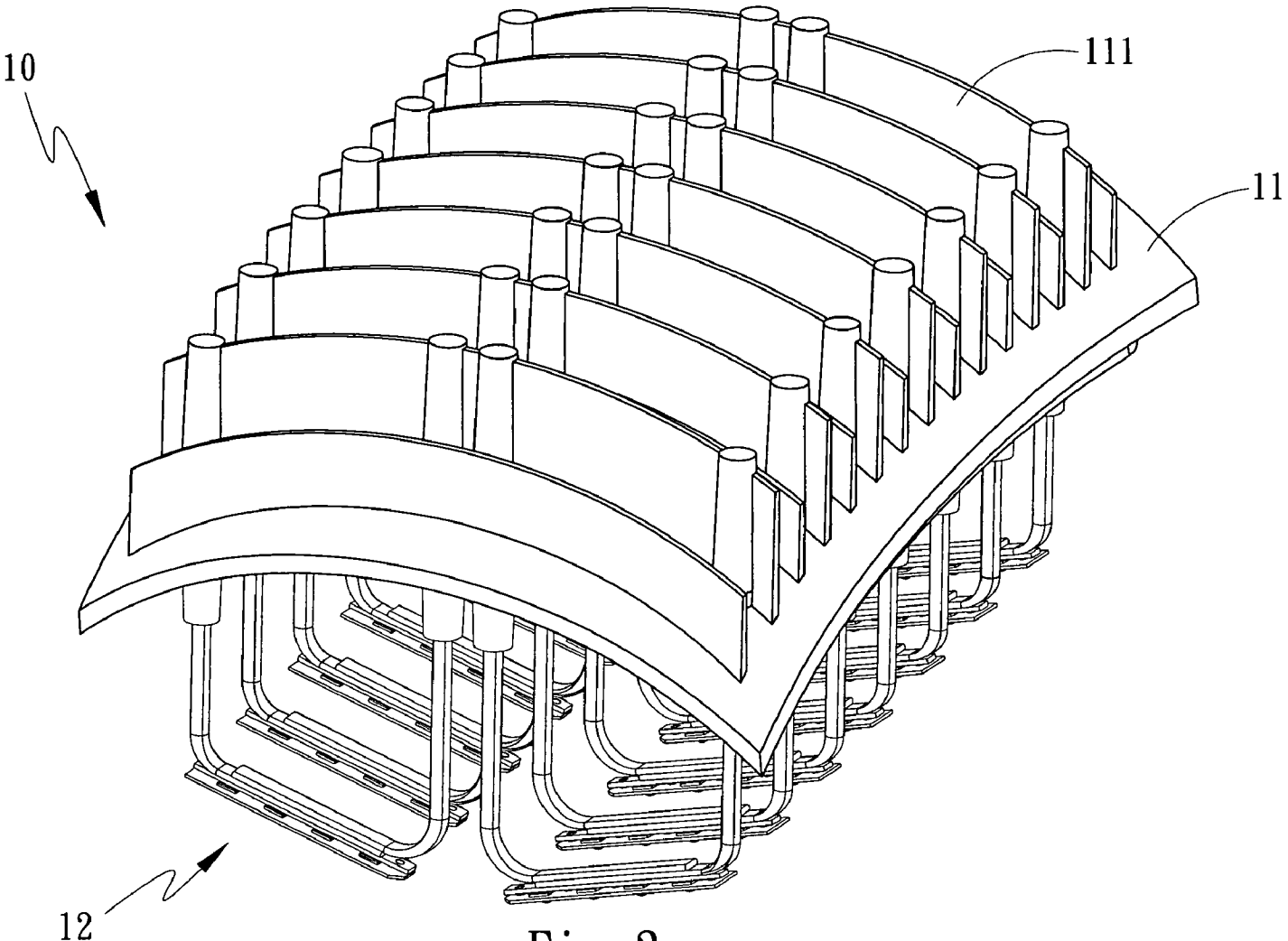
FIG. 3 is a perspective view of the assembly of a heat-dissipation lamp frame according to the present invention.
Figure 4:
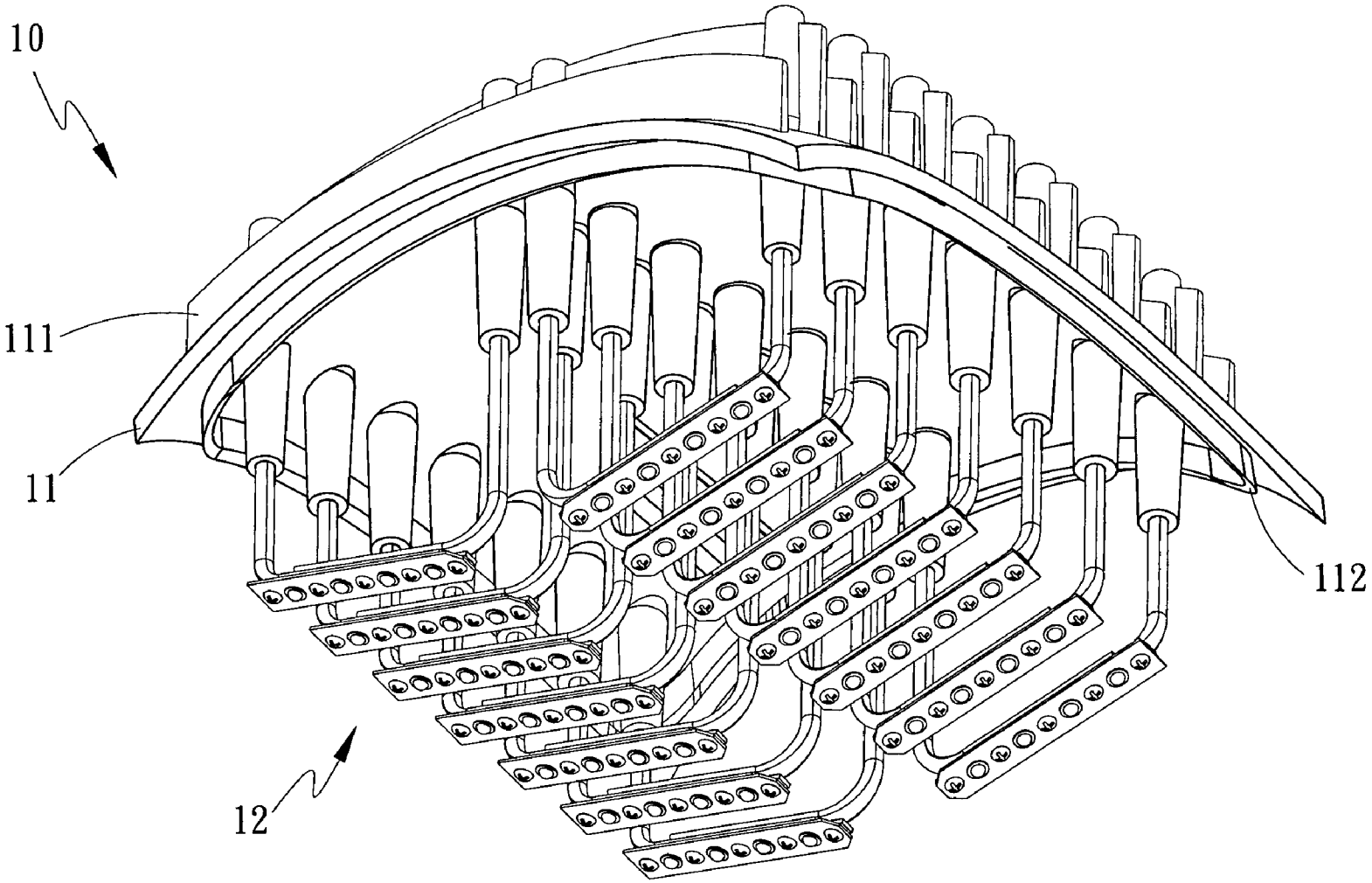
FIG. 4 is another perspective view of the assembly of a heat-dissipation lamp frame according to the present invention.

Refer to FIG. 1, FIG. 2, FIG. 3 and FIG. 4. The improved heat-dissipation structure of the present invention comprises: a heat-dissipation lamp frame 10, a casing 20, a light guiding tube 30 and a light-permeable cover 40. The heat-dissipation lamp frame 10 further comprises: a heat-dissipation structure 11 and a plurality of heat-dissipation lamp sets 12. The heat-dissipation structure 11 has a plurality of heat-dissipation fins 111 on one side thereof, and the heat-dissipation lamp sets 12 are accommodated on the other side of the heat-dissipation structure 11. An inlay slot 112 is formed along the perimeter of the heat-dissipation lamp sets 12 and on the heat-dissipation structure 11 and is used to accommodate the light guiding tube 30. The casing 20 is a metallic shell and has a through-hole 21 on one side thereof to accept the heat-dissipation lamp frame 10. The casing 20 has an opening 22 on the other side thereof. The light guiding tube 30 passes through the opening 22 and is inlaid in the inlay slot 112. The light guiding tube 30 is a hollow and tube-like structure. The light guiding tube 30 has an inlay rim 31 on one side thereof, which is to be inlaid into the inlay slot 112 on one side of the heat-dissipation structure 11. The light guiding tube 30 has a flange 32 surrounding the other side thereof, which contacts the light-permeable cover 40 tightly. The light-permeable cover 40 is a light-permeable hood and has a contact plane 41 on one side thereof, which will tightly contact the flange 32 of the light guiding tube 30. Because the through-hole 21 of the casing 20 is used to accept the heat-dissipation lamp frame 10, the inner dimensions of the through-hole 21 are slightly smaller than the outer dimensions of the heat-dissipation lamp frame 10. Besides, the dimensions of the opening 22 of the casing 20 are slightly larger than the outer dimensions of the light guiding tube 30.

Figure 5:
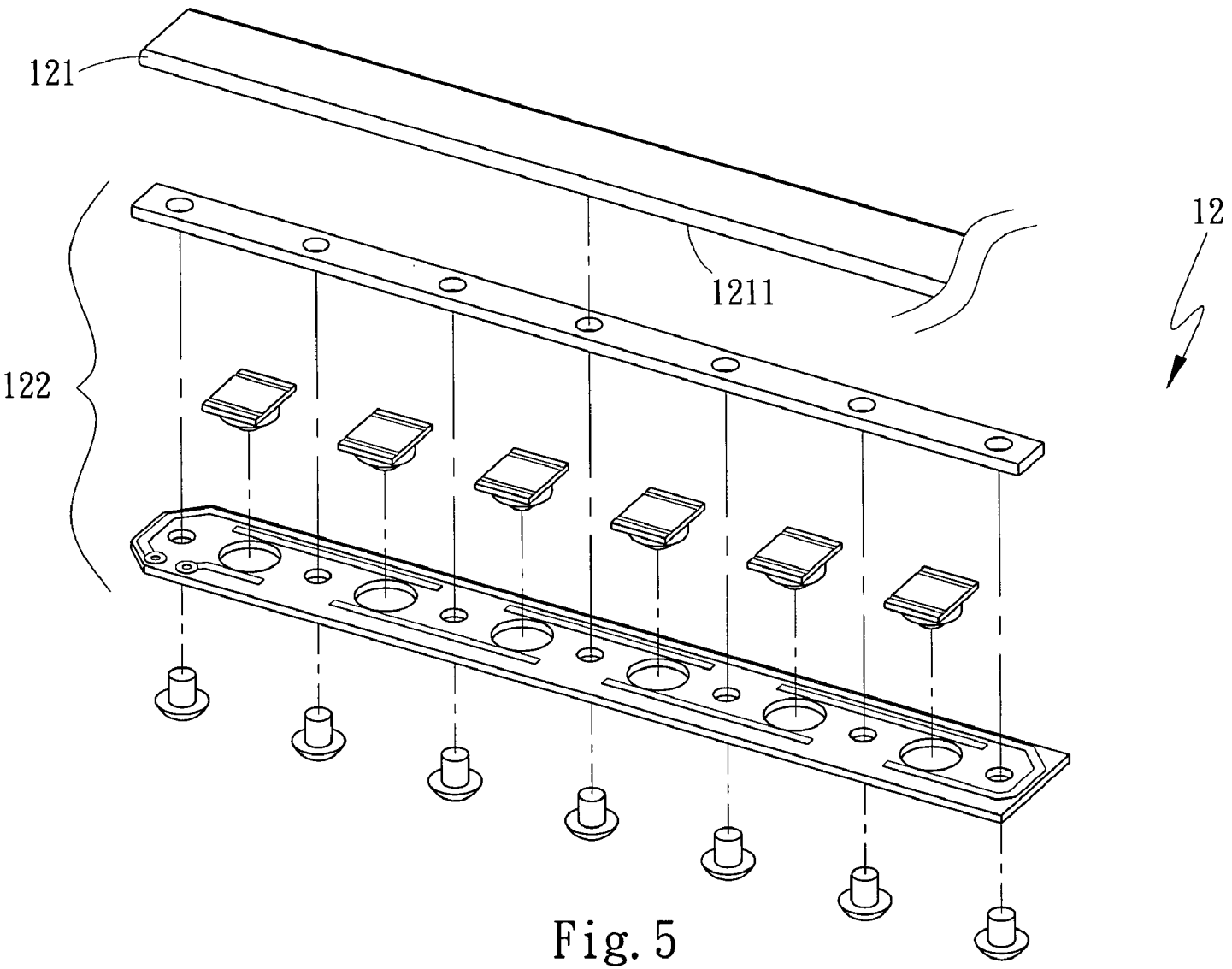
FIG. 5 is a perspective exploded view of an LED lamp set according to the present invention.
Figure 6:
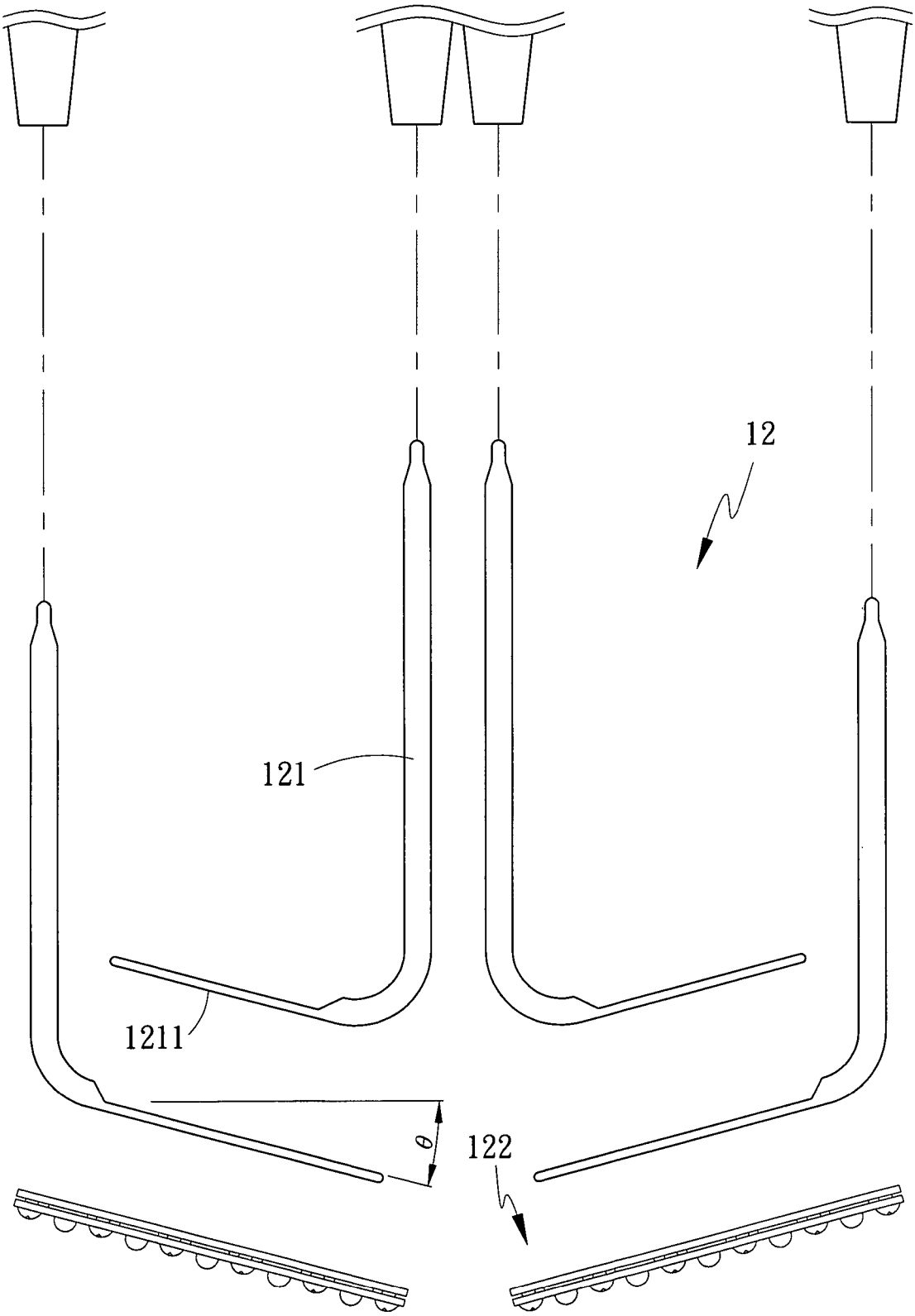
FIG. 6 is a perspective exploded view of LED lamp sets and heat-conduction pipes according to the present invention.

Refer to FIG. 5 and FIG. 6. The heat-dissipation lamp set 12 further comprises: a plurality of heat-conduction pipes 121 and a plurality of LED (Light Emitting Diode) lamp sets 122. The heat-conduction pipe 121 is a hollow metallic pipe capable of heat conduction. One end of the heat-conduction pipe 121 has two planes 1211 on two sides thereof, and the LED lamp set 122 is installed in the plane 1211. The LED lamp set 122 further comprises: a plurality of LED lamps, a plurality of heat-conduction blocks, a plurality of baseplates and a plurality of fixing elements. One side of the LED lamp has an electrode plate, and the other side of the LED lamp has an LED. One side of the electrode plate has two electrodes respectively at two edges thereof. A protection ring annularly surrounds the LED. The baseplate is a PCB (Printed Circuit Board) having circuits thereon. The baseplate has a plurality of through-holes, and the LED lamps are inlaid into the through-holes. The baseplate has cascade circuits on one side thereof to cascade the LED lamps to enhance brightness. The baseplate also has a plurality of via-holes, and the fixing elements are inserted through the via-holes to fasten the baseplate to the heat-conduction block. The heat-conduction block is a metal block having an appropriate thickness and a high thermal conductivity. The heat-conduction block is attached to one side of the electrode plate of the LED lamps and functions as a heat-conduction medium to dissipate the heat generated by the LED lamps. The other side of the heat-conduction block is attached to the planes 1211 of the heat-conduction pipe 121. The heat-conduction block has a plurality of fixing holes, and the fixing elements are fastened into the fixing holes to join together the heat-conduction block and the baseplate. In the present invention, the heat-dissipation lamp frame 10 and the casing 20 can be joined together with an adhesion method. The light guiding tube 30 and the light-permeable cover 40 can also be joined together with the same way.

Refer to FIG. 5 again. In assembling the improved heat-dissipation structure of the present invention, the LED lamps are inlaid into the through-holes of the baseplate to make the electrode-bearing side of the electrode plate contact the cascade circuit-bearing side of the baseplate. Next, one side of the heat-conduction block is attached to the other side of the baseplate so that the heat generated by the LED lamps can be conducted to the heat-conduction block. Next, the fixing elements are inserted through the via-holes of the baseplate and fastened to the fixing holes of the heat-conduction block so that the baseplate and the heat-conduction block can be joined together. Then, the plane 1211 of the heat-conduction pipe 121 is attached to the other side of the heat-conduction block.

Figure 7:
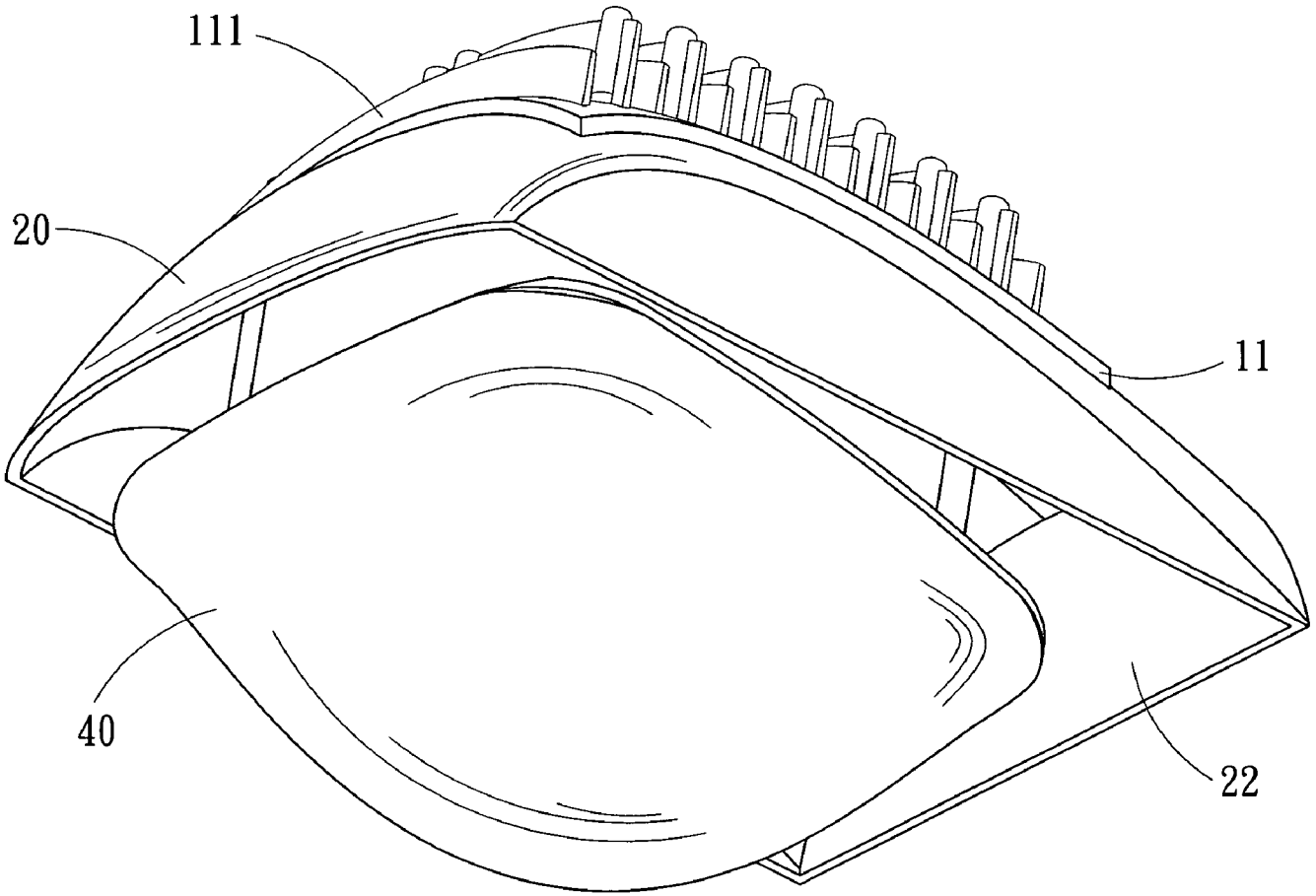
FIG. 7 is a perspective view of the assembly of an improved heat-dissipation structure according to the present invention.
Figure 8A:
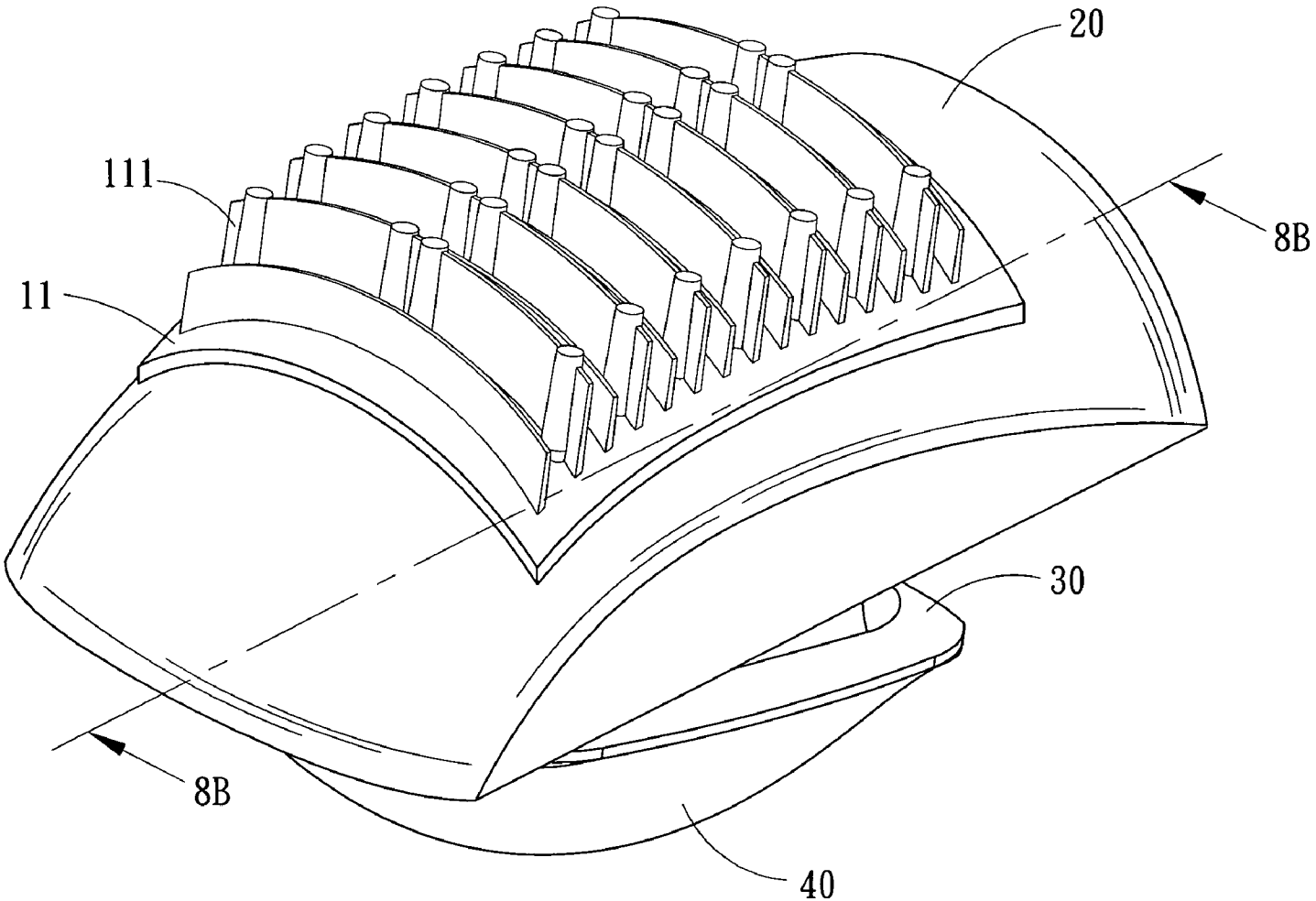
FIG. 8A is another perspective view of the assembly of an improved heat-dissipation structure according to the present invention.
Figure 8B:
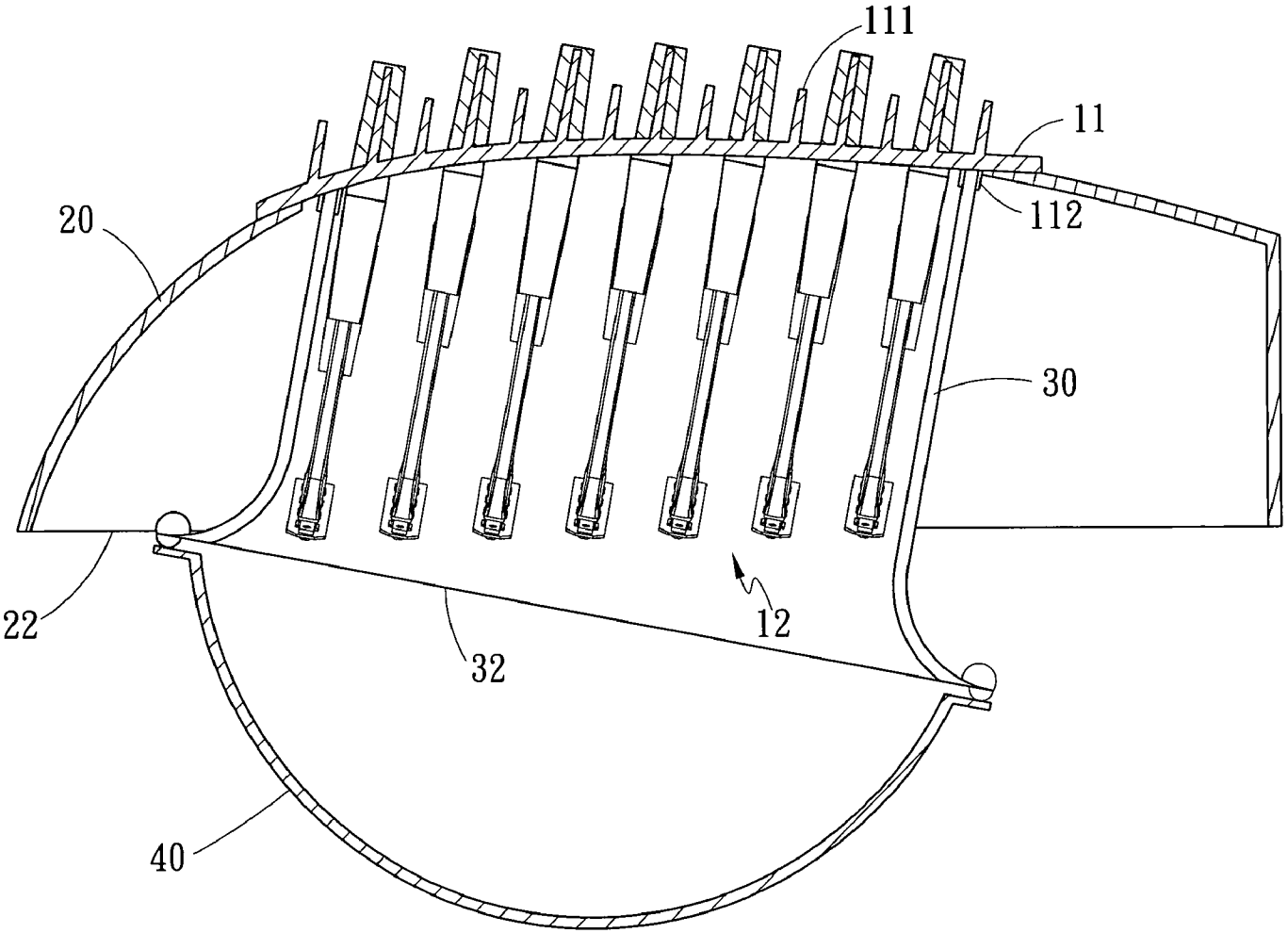
FIG. 8B is a sectional view along Line 8B-8B in FIG. 8A.

Refer to FIG. 1, FIG. 3, FIG. 4 and FIG. 6. After the LED lamp set 122 is assembled to one heat-conduction pipe 121, another heat-conduction pipe 121 is taken to overlap the other plane 1211 of the original heat-conduction pipe 121 to increase the heat-dissipation effect of the entire heat-dissipation lamp set 12. Next, the heat-dissipation lamp sets 12 are inserted into one side of the heat-dissipation structure 11. Next, the heat-dissipation lamp frame 10 is inserted into the through-hole 21 of the casing 20. Next, the light guiding tube 30 is inserted through the opening 22 of the casing 20, and the inlay rim 31 of the light guiding tube 30 is fixedly inlaid into the inlay slot 112 of the heat-dissipation lamp frame 10. Refer to FIG. 7, FIG. 8A and FIG. 8B. Then, the contact plane 41 of the light-permeable cover 40 is taken to contact the flange 32 of the guiding tube 30. As shown in FIG. 6, the heat-conduction pipes 121 are tilted outward by an appropriate angle θ so that the light from the LED lamp sets 122 can spread outward to illuminate a larger area.

Figure 9A:
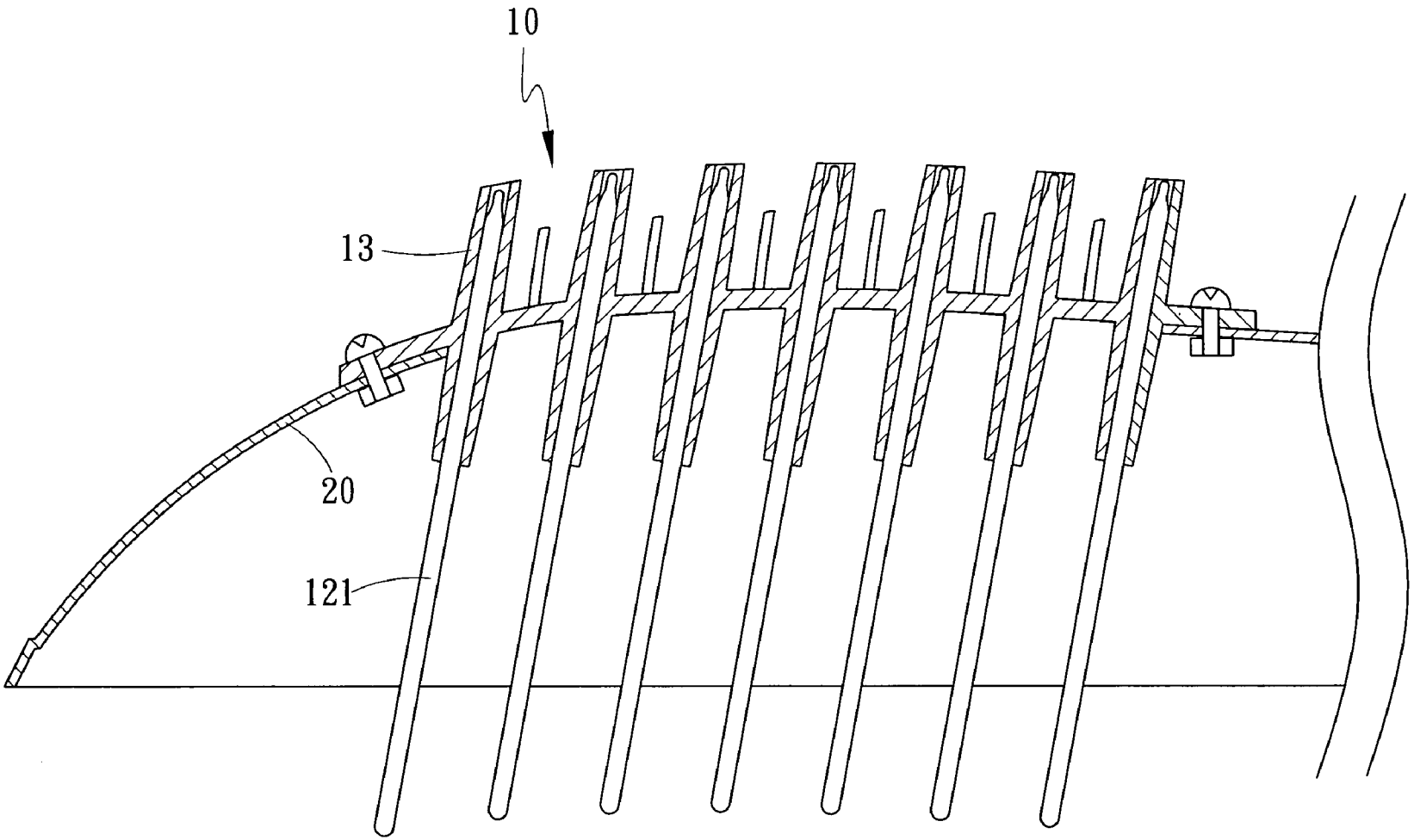
FIG. 9A is a diagram schematically showing insertion pipes according to one embodiment of the present invention.
Figure 9B:
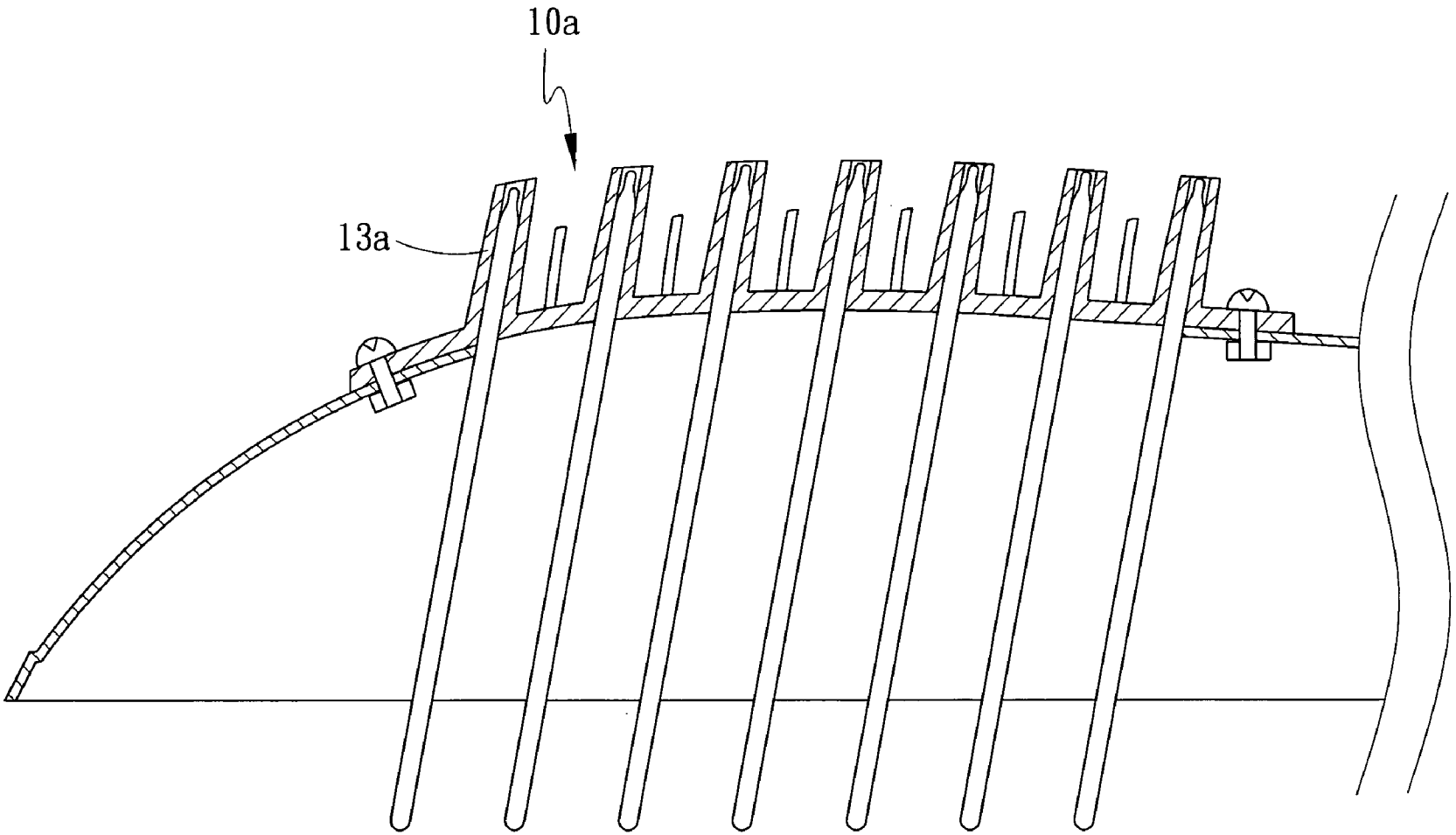
FIG. 9B is a diagram schematically showing insertion pipes according to another embodiment of the present invention.
Figure 9C:
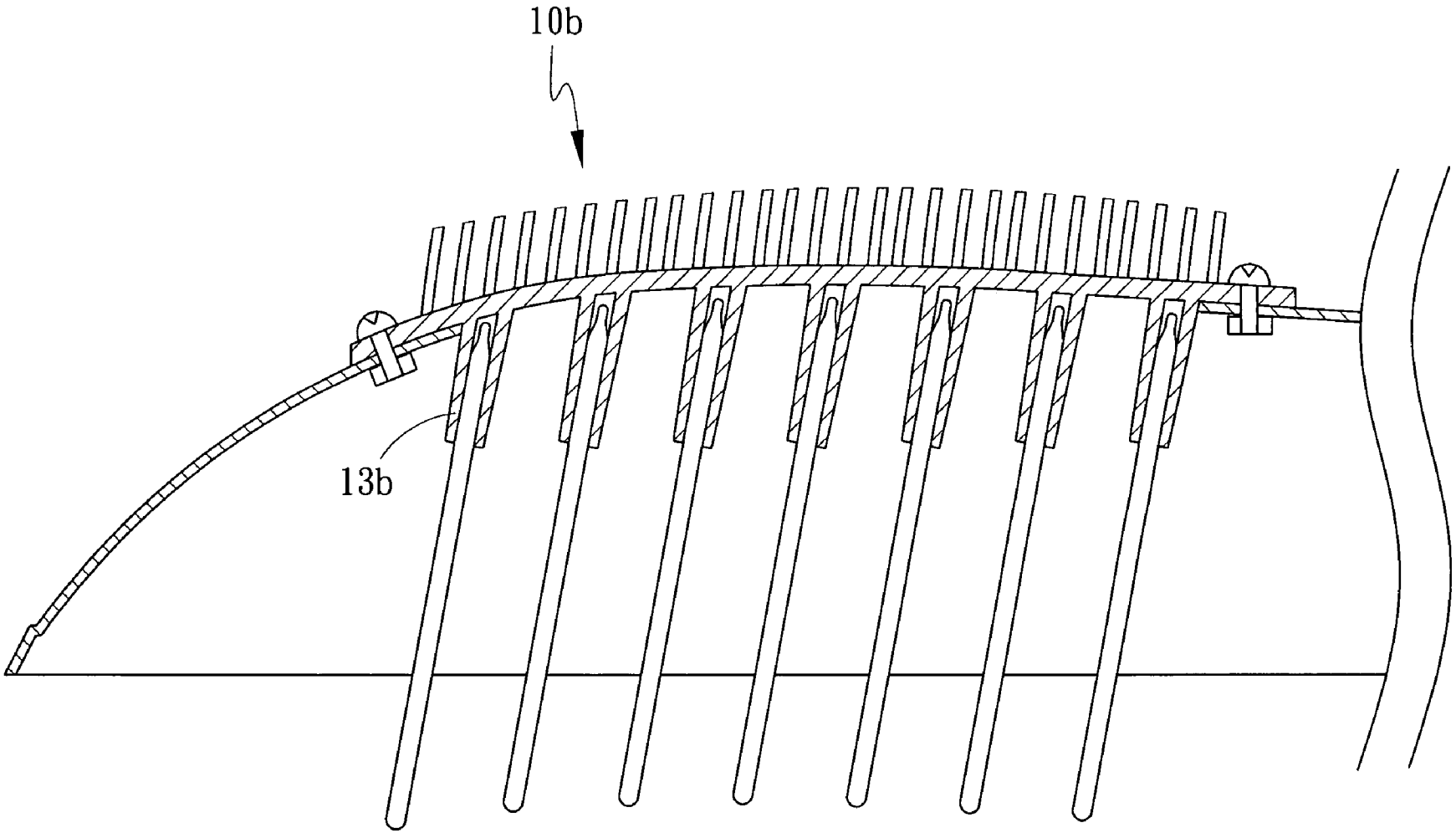
FIG. 9C is a diagram schematically showing insertion pipes according to further another embodiment of the present invention.
Figure 10A:
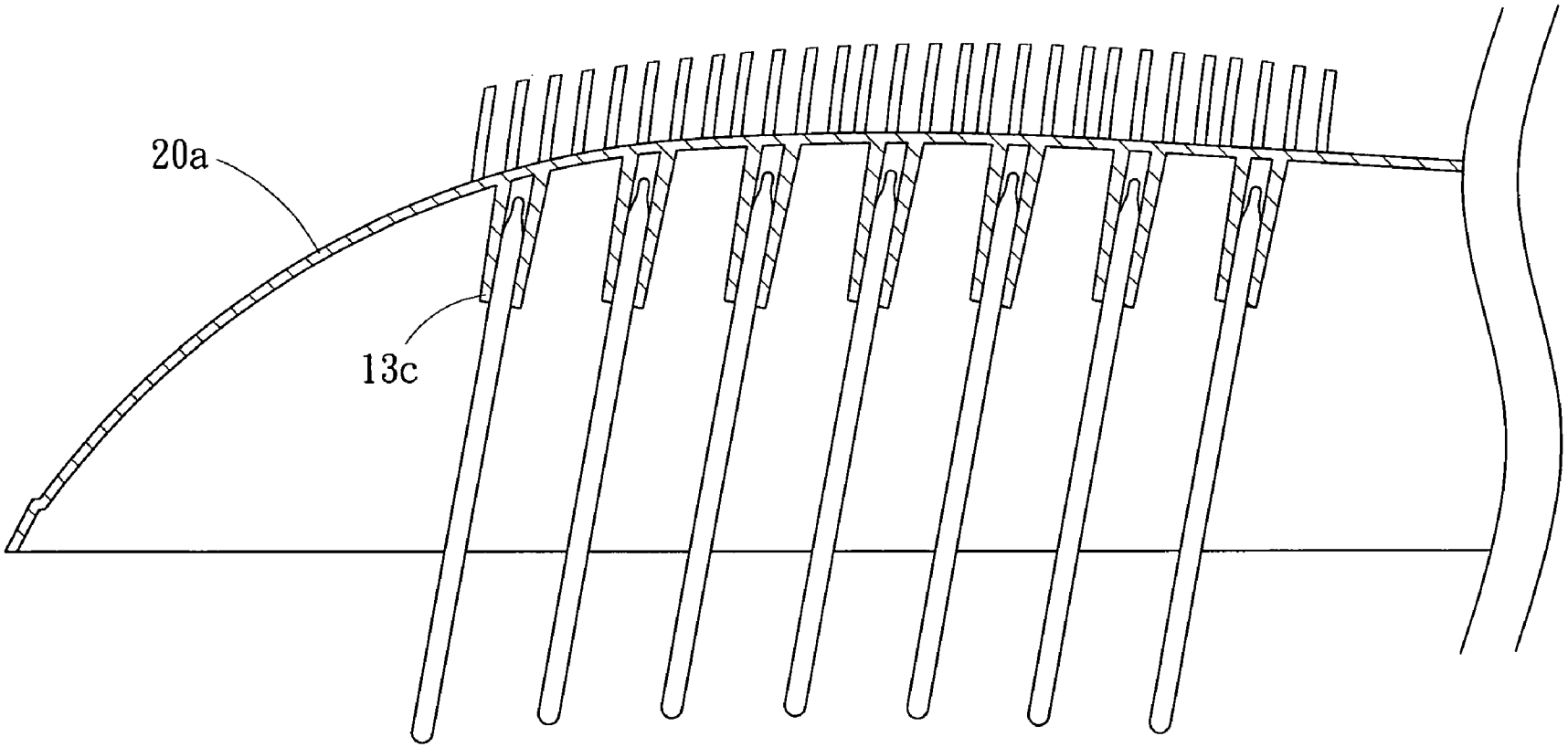
FIG. 10A is a diagram schematically showing a casing according to one embodiment of the present invention.
Figure 10B:
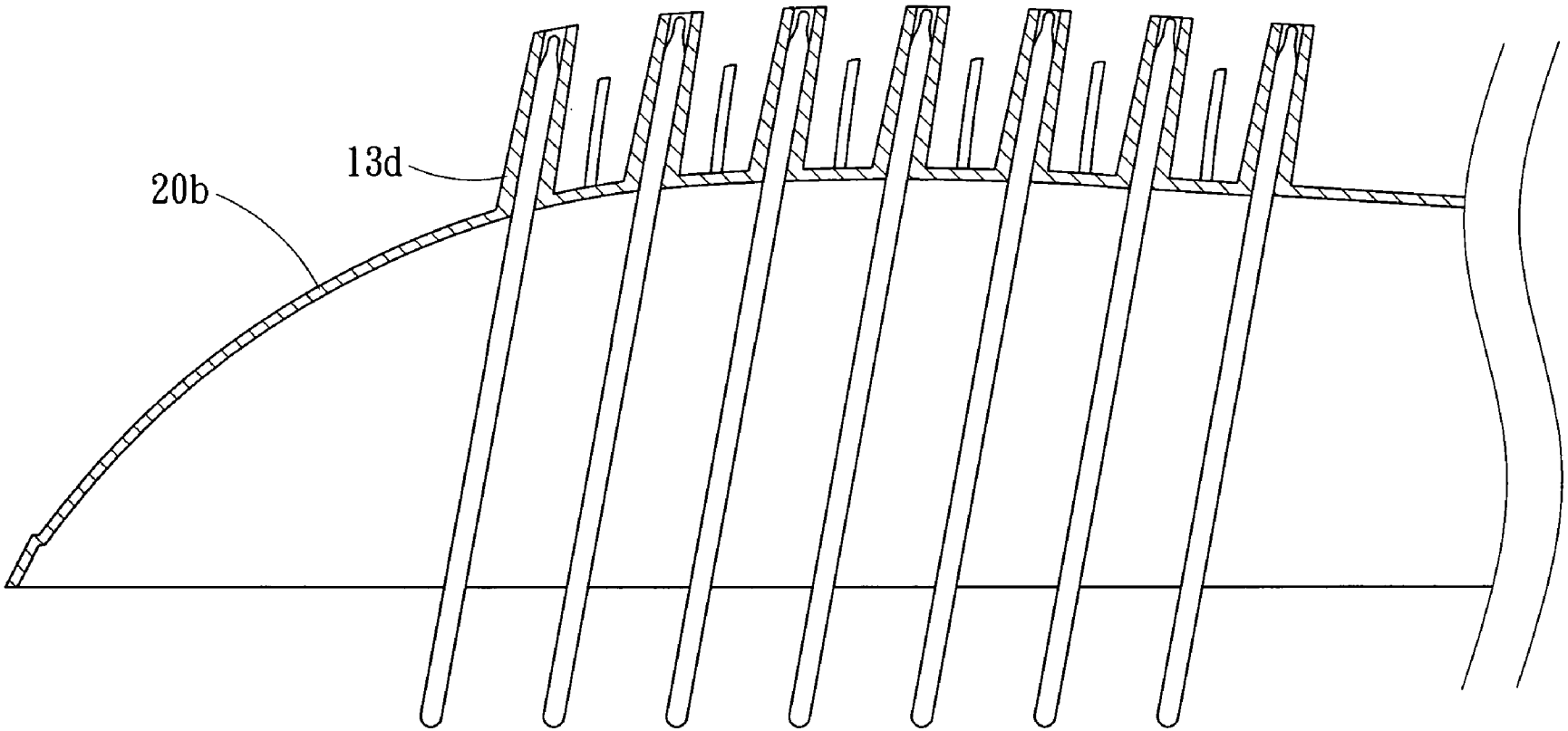
FIG. 10B is a diagram schematically showing a casing according to another embodiment of the present invention.
Figure 10C:
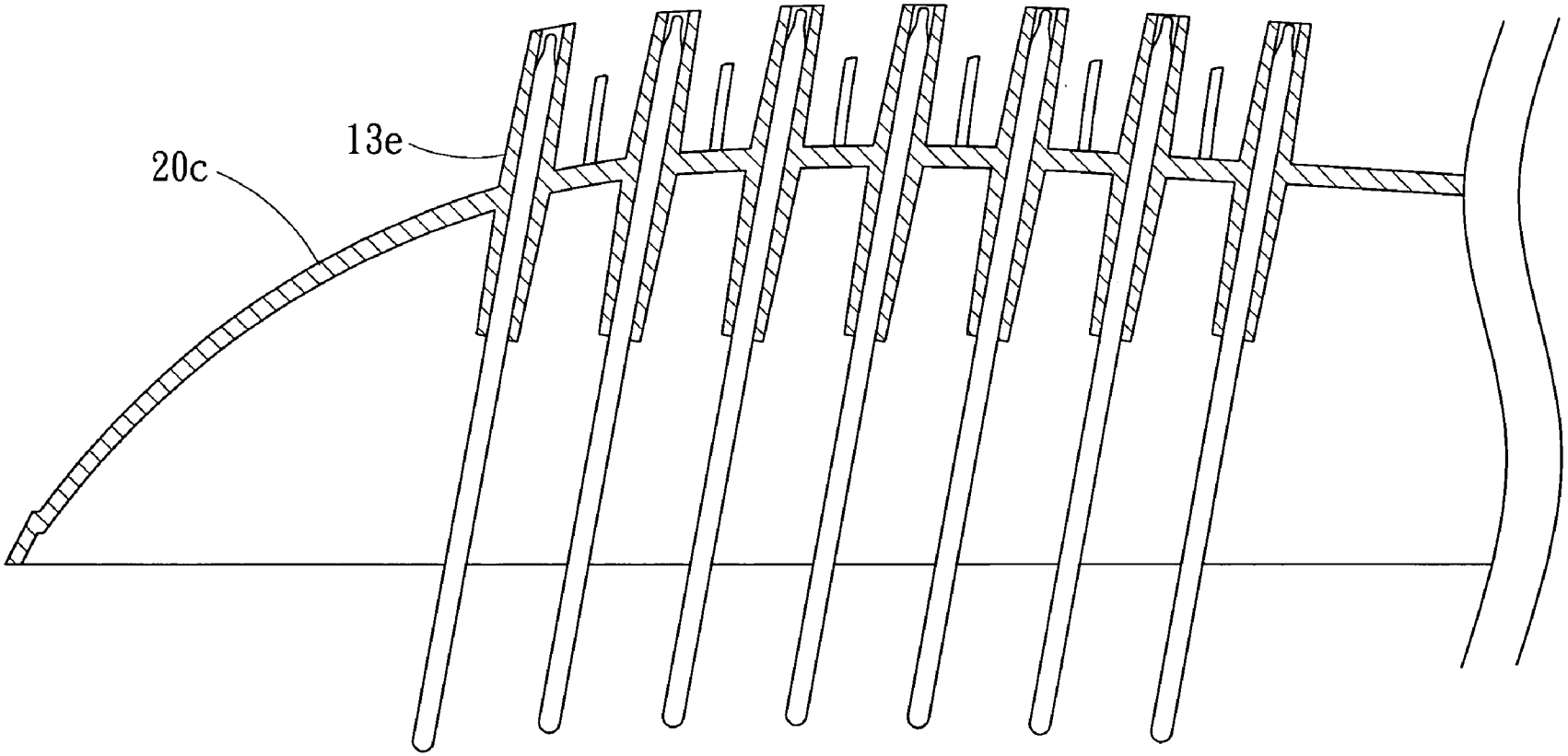
FIG. 10C is a diagram schematically showing a casing according to further another embodiment of the present invention.

Refer to FIG. 9A. A plurality of insertion pipes 13 is arranged on the heat-dissipation lamp frame 10, and the heat-conduction pipes 121 are inserted into the insertion pipes 13; thereby, heat can be rapidly transferred to the heat-dissipation lamp frame 10 and the casing 20 and then emitted therefrom. Refer to FIG. 9B and FIG. 9C also. The insertion pipes 13, 13*a*, 13*b* may be arranged on one side or both sides of the heat-dissipation lamp frame 10, 10*a*, 10*b*. Refer to FIG. 10A, FIG. 10B and FIG. 10C. The insertion pipes 13*c* are integrated with the casing 20*a* to form a one-piece component so that the fabrication process can be simplified. Further, the insertion pipes 13*d*, 13*e* may be formed to protrude from one side or both sides of the casing 20*b*, 20*c*.

What is claimed is:

1. An improved heat-dissipation structure, comprising:

a heat-dissipation lamp frame, including a heat-dissipation structure and a plurality of heat-dissipation lamp sets, wherein said heat-dissipation structure has a plurality of heat-dissipation fins on one side thereof, and said heat-dissipation lamp sets are accommodated on the other side of said heat-dissipation structure, and an inlay slot is formed on the other side of said heat-dissipation structure and along the perimeter of said heat-dissipation lamp sets;

a light guiding tube, being a hollow and tube-like structure, having an inlay rim on onside thereof, which is to be engaged with said heat-dissipation structure, and having a flange on the other side thereof;

a light-permeable cover, being a light-permeable hood and having a contact plane on one side thereof, which can tightly contact said flange of said light guiding tube to implement the joints of said light guiding tube and said light-permeable cover; and a casing, being a metallic shell, having a through-hole on one side thereof to accept said heat-dissipation lamp frame, and having an opening on the other side thereof, wherein said light guiding tube passes through said opening and is inlaid into said inlay slot of said heat-dissipation lamp frame.

2. The improved heat-dissipation structure according to claim 1, wherein said heat-dissipation lamp set further comprises: a plurality of heat-conduction pipes and a plurality of LED (Light Emitting Diode) lamp sets with said heat-conduction pipe being a hollow metallic pipe capable of heat conduction and having a plane in one end thereof to accommodate said LED lamp set.

3. The improved heat-dissipation structure according to claim 1, wherein said through-hole of said casing is used to accept said heat-dissipation lamp frame, and the inner dimensions of said through-hole are slightly smaller than the outer dimensions of said heat-dissipation lamp frame.

4. The improved heat-dissipation structure according to claim 1, wherein the dimensions of said opening of said casing are slightly larger than the outer dimensions of said light guiding tube.

5. The improved heat-dissipation structure according to claim 2, wherein said planes of said heat-conduction pipes are tilted outward by an appropriate angle so that the light from said LED lamp sets can spread outward to illuminate a larger area.

* * * * *